US010954952B2

(12) United States Patent
Boeglin

(10) Patent No.: US 10,954,952 B2
(45) Date of Patent: Mar. 23, 2021

(54) CENTRIFUGAL PUMP FOR CRYOGENIC PUMPED MEDIA

(71) Applicant: Fives Cryomec AG, Allschwil (CH)

(72) Inventor: Stéphane Boeglin, Liebenswiller (FR)

(73) Assignee: Fives Cryomec AG, Allschwil (CH)

( * ) Notice: Subject to any disclaimer, the term of this patent is extended or adjusted under 35 U.S.C. 154(b) by 148 days.

(21) Appl. No.: 16/134,260

(22) Filed: Sep. 18, 2018

(65) Prior Publication Data

US 2019/0085858 A1 Mar. 21, 2019

(30) Foreign Application Priority Data

Sep. 19, 2017 (CH) ..... 1152/17

(51) Int. Cl.
*F04D 29/059* (2006.01)
*F04D 29/40* (2006.01)
(Continued)

(52) U.S. Cl.
CPC ..... *F04D 29/059* (2013.01); *F04D 7/02* (2013.01); *F04D 13/0633* (2013.01);
(Continued)

(58) Field of Classification Search
None
See application file for complete search history.

(56) References Cited

U.S. PATENT DOCUMENTS 3,369,715 A 2/1968 Carter
3,652,186 A 3/1972 Carter
(Continued)

FOREIGN PATENT DOCUMENTS

CH 389409 A 3/1965
DE 1 801 864 A1 4/1969
(Continued)

OTHER PUBLICATIONS

E. Sloan, "Designing with Hybrid Bearings", Sep. 12, 2016, Eureka Magazine, retrieved from https://www.eurekamagazine.co.uk/design-engineering-features/technology/designing-with-hybrid-bearings/145544/ (Year: 2016).*
(Continued)

*Primary Examiner* — Justin D Seabe
*Assistant Examiner* — Jason G Davis
(74) *Attorney, Agent, or Firm* — Banner & Witcoff, Ltd.

(57) ABSTRACT

In a rotary direct-drive single-stage or multi-stage centrifugal pump (1) for cryogenic liquids, having a pump housing (2) for the pump (1) and an electric drive motor unit (12) in a motor housing (10) serving as a pump drive, wherein a shaft (11) of the drive motor unit (12) is mounted on two roller bearings (20; 21), and wherein at least one roller bearing (20; 21) is an unlubricated roller bearing, the structural design of the centrifugal pump (1) should be kept as simple as possible. This is achieved in that at least a first communicating connection, in particular a direct connecting channel (16), is configured between the pressure side (D) in the pump housing (2) and the roller bearing (21) on the pump housing side for a diverted part ($F_{A1}$) of the main conveying flow ($F_H$) of the cryogenic pumped medium to the roller bearing (21), and that a second communicating connection is configured between the roller bearing (21) on the pump housing side and the suction side (S) for the diverted part ($F_{A2}$) of the cryogenic pumped medium back to the suction side (S) in the main conveying flow ($F_H$) of the cryogenic pumped medium, so that a circulation of the diverted part ($F_{A1}$, $F_{A2}$) of the cryogenic pumped medium is ensured between the pressure side (D) in the pump housing (2) and only the roller bearing (21) on the pump housing side.

12 Claims, 1 Drawing Sheet

(51) Int. Cl.

| | |
|---|---|
| ***F04D 7/02*** | (2006.01) |
| ***F04D 29/049*** | (2006.01) |
| ***F04D 29/06*** | (2006.01) |
| ***F04D 13/06*** | (2006.01) |
| ***F04D 29/12*** | (2006.01) |

(52) U.S. Cl.
CPC ..... *F04D 29/049* (2013.01); *F04D 29/061* (2013.01); *F04D 29/126* (2013.01); *F04D 29/406* (2013.01); *F05C 2203/0886* (2013.01)

(56) References Cited

U.S. PATENT DOCUMENTS 3,694,110 A 9/1972 Guinard
4,047,847 A * 9/1977 Oikawa ..... F04D 13/025 417/370
4,684,329 A * 8/1987 Hashimoto ..... F04D 13/0633 417/357
4,808,087 A * 2/1989 Tsutsui ..... F04D 13/064 417/369
6,722,854 B2 * 4/2004 Forsberg ..... F04D 13/0633 417/63
9,188,128 B2 * 11/2015 Lee ..... F04D 13/06
2012/0139250 A1 * 6/2012 Inman ..... E21B 21/10 290/52
2016/0090864 A1 * 3/2016 Finley ..... F04D 13/086 415/1

FOREIGN PATENT DOCUMENTS

JP 2011185217 A 9/2011
JP 2014/020491 A 2/2014
WO 2016049377 A1 3/2016

OTHER PUBLICATIONS

Feb. 16, 2017—Search Report CH App No. 01152/72.

* cited by examiner

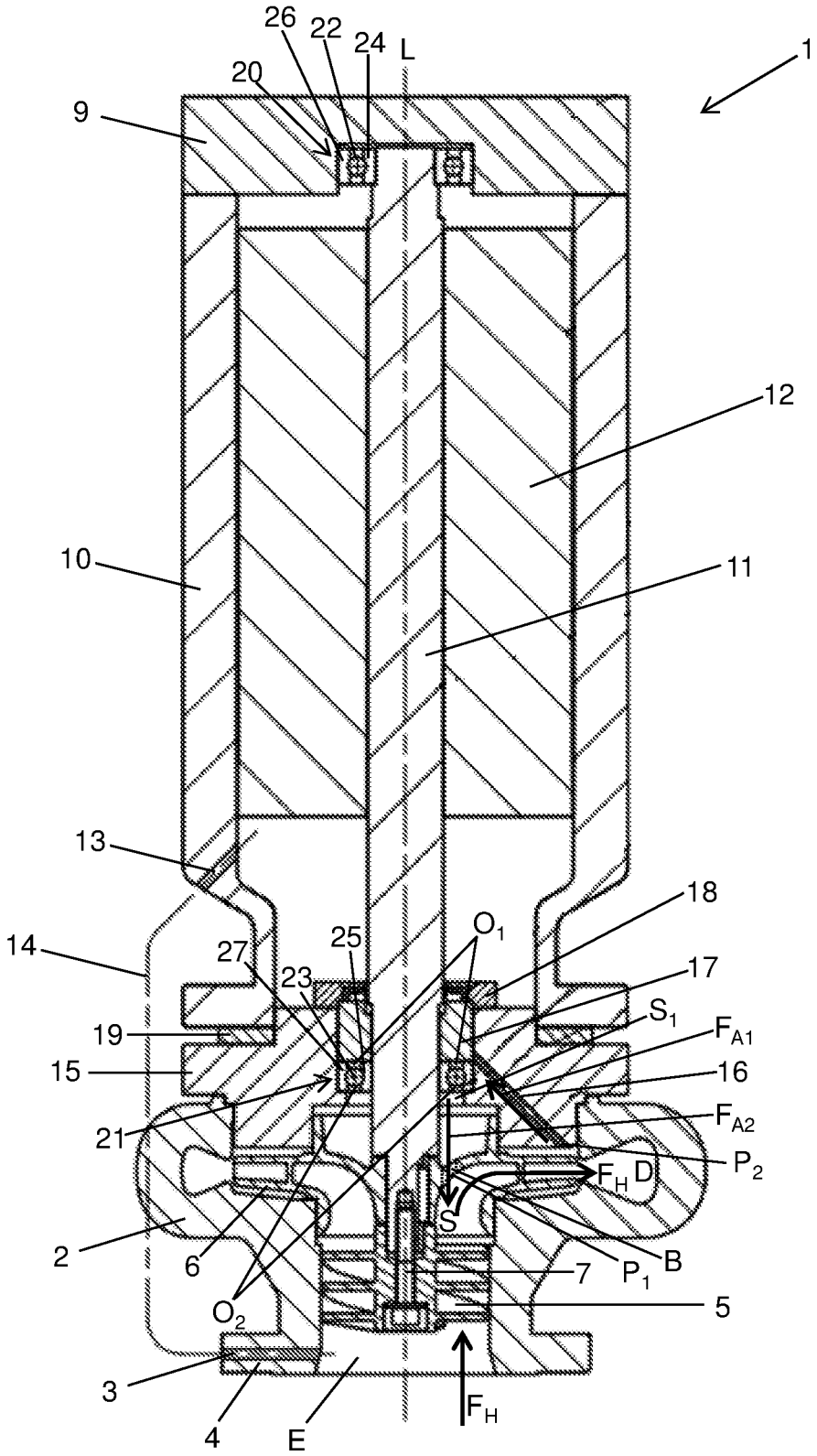
26
22
24
L
20
1
9
12
10
11
13
18
14
25
O1
27
23
17
S1
19
FA1
15
16
21
FA2
P2
FH
D
S
2
6
B
P1
7
5
O2
3
FH
4
E

CENTRIFUGAL PUMP FOR CRYOGENIC PUMPED MEDIA

CROSS-REFERENCE TO RELATED APPLICATIONS

This application claims priority under 35 U.S.C. § 119 to Application CH 01152/17, filed Sep. 19, 2017, the contents of which is hereby incorporated by reference in its entirety.

TECHNICAL AREA

The present invention describes a centrifugal pump for cryogenic pumped media according to the preamble of the first claim.

STATE OF THE ART

Pumps for cryogenic media are known from the prior art. A well-known weakness, especially in centrifugal pumps for use with cryogenic pumped media, is the commonly used roller bearings on which a motor shaft is mounted.

The effects of a cryogenic pumped medium on lubricated roller bearings are known per se. It has been found that common lubricants are generally dissolved at least in part fairly rapidly by vapors produced in or penetrating into the bearing region. These effects are evident in principle for all known lubricants for roller bearings and they are evident over time even when specially sealed lubricated bearings are used.

Because of this lubricant problem, therefore, solutions for pumps with cryogenic pumped media have also been developed, wherein the roller bearings are not lubricated.

Such a solution of a pump for cryogenic pumped media with unlubricated roller bearings is known, for example, from Japanese Patent Document JP 2014/020491 A. According to this document, races made of steel are used, wherein the steel has undergone a cryogenic hardening. The rolling bodies can also be made of steel with cryogenic hardening or made of ceramic. According to the solution shown in this document, it is therefore to be attempted to increase the abrasion resistance of the bearings in order to be able to dispense with the use of lubricants.

However, it has been found that material combinations of metal and ceramic in unlubricated roller bearings or ball bearings (also commonly referred to as rolling bearings) in pumps, in particular centrifugal pumps, do not offer sufficient reliability. The more the rotary speed of the motor shaft is increased, the higher the friction-related load between the individual components of the roller bearing.

Since the possibilities with regard to optimizing the material pairings or material combinations of the unlubricated roller bearing hit their limits, solutions of pumps for cryogenic pumped media with so-called cryogenic lubrication of the roller bearings, i.e., a lubrication based on a part of the cryogenic pumped medium, are also known.

For example, a centrifugal pump for conveying a cryogenic medium is known from U.S. Pat. No. 3,652,186. The centrifugal pump comprises a main conveying flow of the cryogenic pumped medium between the inlet side or suction side, and the outlet side or pressure side.

Openings are provided in an outlet flange in the outlet region, i.e., on the pressure side of the centrifugal pump shown in U.S. Pat. No. 3,652,186, wherein via these openings, a part of the exiting, cryogenic pumped medium is diverted from the main conveying flow and is conducted to a connecting piece on the pump housing via pipelines arranged outside of the pump housing.

The connecting piece is located substantially in the same axial position as the upper roller bearing, i.e., the roller bearing farther from the pump wheel, wherein a communicating connection between the connecting piece and the upper roller bearing is provided by a bore in an upper housing cover. This achieves a lubrication of the upper roller bearing and a cooling of the upper roller bearing.

The lower roller bearing, i.e., located nearer to the pump housing or pump housing side, is also supplied with the diverted part of the cryogenic pumped medium in which enough clearance is present between the roller bearing housing and the shaft for the passage of the cryogenic pumped medium at this point. At the outlet point from the lower roller bearing, the diverted part of the cryogenic pumped medium can be returned in the main conveying flow of the cryogenic pumped medium along the motor shaft and via a gap above the running wheel designed as an impeller.

Furthermore, a further centrifugal pump for conveying a cryogenic medium is known from DE 1 801 864, in which a part of the cryogenic pumped medium is diverted from the main conveying flow on the pressure side and via a pipeline system located outside the pump to a connecting piece located above the upper roller bearing.

A one-piece shaft, which functions both as a motor shaft and as a pump shaft, has in DE 1 801 864 a bore extending between the roller bearings, whereby a cavity is configured in this region of the shaft. There is a communicating connection between the connecting piece in the cavity in the shaft. Additional bores in the shaft also create a communicating connection between this cavity of the shaft and the roller bearings.

However, the centrifugal pumps known from U.S. Pat. No. 3,652,186 and DE 1 801 864 have the disadvantage that a large number of pipelines, i.e., comparatively long paths, are necessary so that the diverted part of the cryogenic pumped medium can reach the roller bearings and back into the main conveying flow of the cryogenic pumped medium.

PRESENTATION OF THE INVENTION

The present invention has for its object to provide a centrifugal pump which overcomes the disadvantages of the known prior art and in particular keeps the structural design of the centrifugal pump as simple as possible.

These objects are achieved by a centrifugal pump having the features of patent claim 1.

According to the invention, a first communicating connection, in particular a direct connecting channel, is configured between the pressure side in the pump housing and the roller bearing on the pump housing side for a diverted part of the cryogenic pumped medium to the roller bearing, and a second communicating connection is configured between the roller bearing on the pump housing side and the suction side for the diverted part the cryogenic pumped medium back to the suction side in the pump housing, so that a circulation of the diverted part of the cryogenic pumped medium is ensured between the pump housing and the roller bearing on the pump housing side.

Such a circulation between the pressure side and only the roller bearing on the pump housing side within the centrifugal pump according to the invention has proven to be particularly advantageous, as this allows arrangement of a cryogenic lubrication with a simple construction of the pump. For example, it is possible to dispense with pipelines arranged outside the pump housing, in contrast to the centrifugal pumps known from U.S. Pat. No. 3,652,186 and DE 1 801 864, with which the risk of leakage loss can be avoided.

For the purposes of the present invention, a direct connecting channel between the pressure side in the pump housing and the roller bearing on the pump housing side as the first communicating connection is understood to mean that, in contrast to the centrifugal pump from DE 1801864, no indirect connection with the roller bearing on the pump housing side is configured via the roller bearing on the drive motor side, farther from the pump wheel.

In accordance with the solution according to the invention of a centrifugal pump for cryogenic pumped media, the cryogenic pumped medium diverted for lubrication and cooling can circulate in a comparatively small-scale circuit. As a result, losses of the diverted, cryogenic pumped medium can be kept low.

Furthermore, it is necessary that the cryogenic pumped medium does not evaporate in the region of the unlubricated roller bearing on the pump housing side, which is preferably made possible by preventing falling below a certain minimum pressure. Evaporation of the cryogenic pumped medium in the region of the roller bearings can damage the roller bearings. A comparatively small-scale circulation circuit is advantageous, since this ensures the maintenance of the necessary minimum pressure through the construction.

For the purposes of the present invention, for example, liquid gases such as liquid hydrocarbons such as, for example, liquid methane, liquid nitrogen, etc. may be used as the cryogenic pumped medium. Liquefied gas is understood to mean a gas liquefied by cooling and compression. It has been shown that especially liquid hydrocarbons have good lubricating properties and are therefore particularly well suited for cryogenic lubrication.

Further advantageous embodiments are specified in the dependent claims.

Preferably, an intermediate piece in the form of a housing cover is located between the motor housing and the pump housing, wherein the housing cover has a connecting channel in the form of a bore between the pressure side and the roller bearing on the pump housing side to form the first communicating connection.

Preferably, a sealing element is arranged between the housing cover on the pump housing side and the shaft so as to achieve a barrier between the pump housing and the motor housing. In contrast to the centrifugal pumps known from U.S. Pat. No. 3,652,186 and DE 1801864, the drive motor side in the centrifugal pump according to the invention may preferably be a conventional, lubricated roller bearing. The sealing element serving as a barrier for the cryogenic pumped medium thus advantageously avoids the known problems which occur when the cryogenic pumped medium is brought into contact with lubricated roller bearings and, moreover, forces the diverted part back into the main conveying flow of the cryogenic pumped medium via the second communicating connection.

Preferably, the centrifugal pump according to the invention is designed for use in a horizontal position and thus suitable to be mounted on a truck, for example.

Preferably, the motor housing, in particular at a lowest point in a horizontal position during use, has an outlet bore, wherein a pressure equalization line extending to the suction side can be attached at the outlet bore. Such an outlet bore with an attached pressure compensation line advantageously allows removal of unwanted cryogenic pumped medium present in the motor housing, which is for example, due to a poor barrier effect, for example due to damage or wear of the sealing element between the housing cover on the pump housing side and the shaft entering into the motor housing.

BRIEF DESCRIPTION OF THE DRAWINGS

A preferred embodiment of the subject matter according to the invention is described below in conjunction with the accompanying drawings. It shows:

FIG. 1 a longitudinal section through a preferred embodiment of the centrifugal pump according to the invention.

DESCRIPTION

FIG. 1 shows a longitudinal section through a preferred embodiment of the centrifugal pump 1 according to the invention. The centrifugal pump 1 has a motor housing for an electric drive motor unit 12 and a pump housing 2 for receiving the pump elements. In the present preferred embodiment, it is a single-stage impeller pump with only one pump wheel 5, which may also be a multi-stage impeller pump with multiple pump wheels 5.

The drive motor unit 12 has a shaft 11 which is mounted in two roller bearings 20; 21. A roller bearing 20 on the drive motor side, i.e., farther from the pump wheel 5 or pump housing 2, is in this case mounted in a housing cover 9 on the drive motor side. In the presently preferred embodiment, the shaft 11 is a one-piece shaft which functions both as a motor shaft and as a pump shaft. Alternatively, a design of the centrifugal pump 1 having a non-integral shaft is conceivable in which a motor shaft can be connected to a pump shaft via a coupling. At the free end of the shaft 11 facing the pump housing 2, both a pump wheel 5 and an running wheel 6 designed as an impeller 6 are fastened here by means of a fixing screw 7. The pump wheel 5 is exemplified here as a spiral-shaped conveying paddle.

As can be seen in FIG. 1, a suction flange 4 for the suction of the main conveying flow $F_H$ of the cryogenic pumped medium is arranged on the pump housing 2 on the inlet opening E or suction side S. On the substantially same axial position as the pump housing 2 and substantially at a right angle to the inlet side E, the outlet side is here arranged with an outlet flange for the discharge of the main conveying flow $F_H$ of the cryogenic pumped medium (not visible in FIG. 1).

There is an intermediate piece in the form of a housing cover 15 located between the motor housing 10 and pump housing 2, wherein this housing cover 15 with suitable fixing means establishes a firm connection between the motor housing 10 and the pump housing 2. The housing cover 15 has adapter and separation function. The roller bearing 21 on the pump housing side, i.e., located nearer to the pump housing 2 or pump wheel, is mounted in the housing cover 15. According to the preferred embodiment shown here, an insulating disk 19 is preferably arranged between the housing cover 15 and the motor housing 10.

A first communicating connection is between the pressure side D in the pump housing 2 and the roller bearing on the pump housing side 21, in particular as a direct connecting channel 16, configured for a diverted part $F_{A1}$ of the main conveying flow $F_H$ of the cryogenic pumped medium. The connecting channel 16 is formed here in the shape of a bore in the housing cover 15 and extends here by way of example between roller bearings 21 transversely outwards to an outer radial region of the pump housing 2. In FIG. 1, only one connecting channel 16 is shown, wherein definitely one or more connecting channels 16 may be present as needed.

During operation of the centrifugal pump 1, a pressure $P_2$ increases on the pressure side D in the outer radial region of the pump housing 2 against a pressure $P_1$ at the suction side S in an inner radial region of the pump housing 2 due to the centrifugal forces. The pressure $P_2$ on the pressure side D usually corresponds to the pressure to be achieved of the exiting main conveying flow $F_H$ of the cryogenic pumped medium. In other words, a pressure gradient forms, wherein: $P_2>P_1$. This pressure gradient causes a diversion of a part $F_{A1}$ from the main conveying flow $F_H$ of the cryogenic pumped medium in the direction of the roller bearing 21 and thereby a flow through or a to the roller bearing and cryogenic lubrication and cooling of the roller bearing 21. In other words, the circulation is ensured by the pressure gradient or the pressure difference between pressure side D and suction side S. It has been found that in the centrifugal pump 1 according to the invention, a pressure gradient or a pressure difference between $P_1$ and $P_2$ can be adjustable from 0.8 to 8 bar, wherein this pressure gradient can be influenced in particular by the pump speed and the diameter of the running wheel.

Between the roller bearing 21 and the suction side S in the pump housing 2, a second communicating connection is configured for the return of the diverted part $F_{A2}$ of the cryogenic pumped medium back to the suction side S in the pump housing 2, so that a circulation of the diverted part $F_{A1}$; $F_{A2}$ of the cryogenic pumped medium between the pressure side D in the pump housing 2 via the roller bearing 21 on the pump housing side back to the suction side S is ensured. According to the preferred embodiment shown here in FIG. 1, the second communicating connection is designed in the shape of at least one lower opening $O_2$ of the roller bearing on the pump housing side 21 and can thus reach an upper suction side $S_1$. In addition, the second communicating connection here includes, by way of example indicated by dashed lines, at least one bore B in the running wheel 6, whereby the diverted part $F_{A2}$ of the cryogenic pumped medium can pass from an upper suction side $S_1$ back to the suction side S. It has been found that there is a slightly higher pressure than the pressure $P_1$ on the suction side S between the upper suction side $S_1$, whereby the diverted part $F_{A2}$ of the cryogenic pumped medium can get back into the main conveying flow $F_H$ of the cryogenic pumped medium.

An annular shaped sealing element 18 surrounding the shaft 11 is arranged between the housing cover 15 and the shaft 11 to provide a seal and to achieve a barrier between the pump housing 2 and the motor housing 10. This sealing element 18 forces, as can be seen in FIG. 1 in the direction facing away from the motor housing 10, the diverted part $F_{A2}$ of the cryogenic pumped medium via the second communicating connection back into the main conveying flow $F_H$ of the cryogenic pumped medium. The preferred exemplary embodiment shown in FIG. 1 also has by way of example, in addition to the sealing element 18, a labyrinth seal 17 between the unlubricated roller bearing 21 and the sealing element 18. The centrifugal pump 1 according to the invention allows a flow of the diverted part $F_{A1}$ of the cryogenic pumped medium through a gap between the labyrinth seal 17 and the roller bearing 21, so that the diverted part $F_{A1}$ of the cryogenic pumped medium can enter into the roller bearing 21 via at least one upper opening O1 and can be lubricated by the cryogenic pumped medium.

Ideally, the centrifugal pump 1 is designed or suitable to be operated in a horizontal position, i.e., in a horizontally oriented longitudinal axis of the shaft 11, for use, for example, on a truck. For example, the centrifugal pump 1 is preferably configured such that the outlet bore 13 shown in FIG. 1 is aligned and arranged in the motor housing 10 at a lowest point in the direction of gravity, whereby liquid cryogenic pumped medium undesirably located in the motor housing 10 can collect at this point. As indicated in FIG. 1 by a dashed line, a pressure equalization line 14 is preferably sealingly attached to the outlet bore 13 and to a bore 3 in the suction flange 4 of the pump housing 2. Such a pressure equalization line 14 is advantageous since the liquid, cryogenic pumped medium is forced from the interior of the motor housing 10 in the direction of the suction side S at the inlet opening E. Such an outlet bore with an attached pressure compensation line advantageously allows removal of unwanted cryogenic pumped medium present in the motor housing, which is, for example, due to a poor barrier effect, for example due to damage or wear of the sealing element 18 between the housing cover 15 on the pump housing side and the shaft 11 entering into the motor housing 10.

The unlubricated roller bearing 21 in the housing cover 15 here comprises a plurality of balls 23, an inner race 25 and an outer race 27 each with running surfaces, between which the balls 23 are arranged, wherein here the balls 23 may be made of ceramic. The races 25; 27 are preferably made of steel and ideally have a chromium-based coating in the region of the running surfaces.

Such an unlubricated roller bearing 21 or ball bearing is also referred to as a hybrid bearing, in which different materials are used for the races 25; 27 and the balls 23 (also called rolling bodies). The most common type is that of the deep groove ball bearing with conventional races 25; 27 made of steel and balls 23 made of a high-strength ceramic, usually silicon nitride.

The roller bearing 20 in the housing cover 9 on the drive motor side can be made identical to the roller bearing 21, but it can also advantageously be a conventional, lubricated roller bearing for cost reasons.

The mutual distance of the balls 23 in the unlubricated roller bearing 21 is ensured by a cage (not shown in FIG. 1), which has a separate chamber for each ball 23. The inner surfaces of the chambers are preferably cylindrical and the cylinder diameter is chosen slightly larger than the diameter of the balls 23, so that the balls can rotate freely in the cage. Preferably, this cage is made of reinforced PTFE (polytetrafluoroethylene). Alternatively or additionally, this cage may also be made of stainless steel, polyetheretherketone (PEEK), brass or any combination thereof.

LIST OF REFERENCE NUMBERS

1 centrifugal pump
2 pump housing
3 bore (in the pump housing)
4 suction flange
5 pump wheel
6 running wheel
7 fixing screw
9 housing cover on the drive motor side
10 motor housing
11 shaft
12 drive motor unit
13 outlet bore (in the motor housing)
14 pressure compensation line (between suction side and pressure side)
15 housing cover on the pump housing side
16 connecting channel (for diverted, cryogenic medium)
17 labyrinth seal
18 sealing element
19 insulating disk
20 roller bearing on the drive motor side

21 roller bearing on the pump housing side
22 ball (upper roller bearing)
23 ball (lower roller bearing)
24 inner race (upper roller bearing)
25 inner race (lower roller bearing)
26 outer race (upper roller bearing)
27 outer race (lower roller bearing)
A outlet opening
B bore (in the running wheel)
D pressure side
E inlet opening
$F_{A1}$ diverted, cryogenic pumped medium (pressure side to the roller bearing)
$F_{A2}$ diverted, cryogenic pumped medium (roller bearing to the suction side)
$F_H$ main conveying flow cryogenic medium
L longitudinal axis
$O_1$ upper opening (of the roller bearing on the pump housing side)
$O_1$ lower opening (of the roller bearing on the pump housing side)
S suction side
$S_1$ upper suction side

The invention claimed is:

1. A rotary direct-drive single-stage or multi-stage centrifugal pump for a cryogenic medium, having a pump housing for the pump and an electric drive motor unit serving as a pump drive in a motor housing, wherein a shaft of the drive motor unit is mounted on two roller bearings and wherein a first roller bearing of said two roller bearings is an initially unlubricated roller bearing that is configured for lubrication during operation of the centrifugal pump by the cryogenic medium, and further wherein the first roller bearing is on a pump housing side and located nearer to the pump housing compared to a second roller bearing on a drive motor side of said two roller bearings, characterized in that a first communicating connection is configured between a pressure side in the pump housing and the first roller bearing on the pump housing side, for a diverted part of a main conveying flow of the cryogenic medium to the first roller bearing, and a second communicating connection is configured between the first roller bearing on the pump housing side and a suction side for the diverted part of the main conveying flow of the cryogenic medium back to the suction side and into the main conveying flow of the cryogenic medium, wherein a circulation of the diverted part of the cryogenic pumped medium is ensured between the pressure side in the pump housing and only the first roller bearing on the pump housing side, wherein a housing cover is located between the motor housing and the pump housing, and the housing cover has a connecting channel in the shape of a bore between the pressure side in the pump housing and the first roller bearing on the pump housing side to form the first communicating connection, and wherein the housing cover and the shaft are sealingly engaged to achieve a barrier between the pump housing and the motor housing.

2. The pump according to claim 1, characterized in that the pump is designed for use in a horizontal position.

3. The pump according to claim 2, characterized in that the motor housing, at a location lowest in said horizontal position, has an outlet bore, wherein a pressure equalization line between the motor housing and the suction side is attachable at the outlet bore.

4. The pump according to claim 1, characterized in that the first roller bearing on the pump housing side, is a hybrid bearing.

5. The pump according to claim 4, characterized in that inner and outer races of the first roller bearing on the pump housing side are made of steel and have a chromium-based coating in a region of running surfaces, and balls of the first roller bearing on the pump housing side are made of a ceramic.

6. The pump according to claim 5, characterized in that the first roller bearing on the pump housing side comprises a cage for mutual spacing of the balls, wherein a separate chamber is created by the cage for each of the balls and wherein the cage is made of reinforced polytetrafluoroethylene (PTFE), stainless steel, polyetheretherketone (PEEK), brass, or a combination thereof.

7. The pump of claim 5, wherein the ceramic is silicon nitride ($Si_3N_4$).

8. A method for operating a pump according to claim 1, comprising at least the method steps:

commissioning the pump for conveying the main conveying flow of the cryogenic medium from an inlet opening to an outlet opening, characterized in that during operation, the diverted part is conducted from the main conveying flow of the cryogenic medium between the pressure side in the pump housing and the first roller bearing on the pump housing side via the first communicating connection, and the diverted part is conducted back to the suction side via the second communicating connection, so that the circulation of the diverted part of the cryogenic medium is ensured between the pressure side in the pump housing and only the first roller bearing on the pump housing side.

9. The method according to claim 8, characterized in that during said operation of the centrifugal pump, due to the centrifugal forces, a pressure on the pressure side, being in an outer radial region of the pump housing, increases with respect to a pressure at the first roller bearing, being arranged in an inner radial region of the pump housing, causing a pressure gradient that diverts a part of the main conveying flow of the cryogenic medium in the direction of the first roller bearing via the first communicating connection and thereby a cryogenic lubrication and cooling of the first roller bearing.

10. The method according claim 8, characterized in that the pump is installed in a horizontal position during said commissioning.

11. The method of claim 8, wherein the first communicating connection is a direct connecting channel for the diverted part of the main conveying flow of the cryogenic medium to the first roller bearing.

12. The pump of claim 1, wherein the first communicating connection is a direct connecting channel for the diverted part of the main conveying flow of the cryogenic medium to the first roller bearing.

* * * * *